US009423171B2

(12) United States Patent
Betto et al.

(10) Patent No.: US 9,423,171 B2
(45) Date of Patent: Aug. 23, 2016

(54) MODULAR REFRIGERATION AND/OR FREEZER APPLIANCE

(75) Inventors: Federico Betto, Lavena Ponte Tresa (IT); Johan Bengt Dahm, Wroclaw (PL); Paolo Molteni, Bovisio Masciago (IT); Anna Pucciarini, Travedona Monate (IT); Monica Restelli, Como (IT); Luca Ruggeri, Fabriano (IT); Alberto Stroppiana, Biandronno (IT); Pierluigi Petrali, Varese (IT); Andrea Picozzi, Rovello Porro (IT); Ruggero Pallaoro, Mala Sant'Orsola Terme Torento (IT); Stefano Casapiccola, Pergine Valsugana (IT); Giovanni Giannico, Trento (IT); Marco Bertuzzi, Cognola (IT); Amneris Aramini, Trento (IT); Daniele Sacchi, Arona (IT)

(73) Assignee: Whirlpool Corporation, Benton Harbor, MI (US)

( * ) Notice: Subject to any disclaimer, the term of this patent is extended or adjusted under 35 U.S.C. 154(b) by 1207 days.

(21) Appl. No.: 12/763,714

(22) Filed: Apr. 20, 2010

(65) Prior Publication Data

US 2010/0264782 A1 Oct. 21, 2010

Related U.S. Application Data

(63) Continuation of application No. 10/599,900, filed as application No. PCT/EP2005/051633 on Apr. 13, 2005, now abandoned.

(30) Foreign Application Priority Data

Apr. 14, 2004 (IT) ..... M12004A0737

(51) Int. Cl.
*A47B 96/04* (2006.01)
*F25D 23/06* (2006.01)

(Continued)

(52) U.S. Cl.
CPC ..... *F25D 23/063* (2013.01); *F25D 17/045* (2013.01); *F25D 23/028* (2013.01);
(Continued)

(58) Field of Classification Search
USPC ..... 312/107, 108, 111, 400, 401, 406, 405, 312/406.2, 265.5, 257.1; 52/79.9, 586.1, 52/586.2, 590.2, 591.1; 220/592.02–592.11; 16/229; 403/331, 403/381, 161, 162
See application file for complete search history.

(56) References Cited

U.S. PATENT DOCUMENTS 2,247,904 A 7/1941 Brace
2,300,405 A 11/1942 Cook (Continued)

FOREIGN PATENT DOCUMENTS

DE 1911903 9/1970
DE 10061778 7/2002

(Continued)

*Primary Examiner* — Daniel J Troy
*Assistant Examiner* — Andres F Gallego

(57) ABSTRACT

A modular refrigeration and/or freezer appliance comprising a base module, a cabinet module comprising U-shaped front and rear plates defining a structure with an open top, bottom, and front, with the front and rear plates spaced from each other to define therebetween a U-shaped insulation compartment with upper and lower edges, an insulation module received within the U-shaped insulation compartment, a bottom closure wall module, a top closure wall module, and a door hingedly coupled to the base module and the cabinet module to selectively close the open front of the cabinet module to form a thermally insulated compartment.

20 Claims, 9 Drawing Sheets

(51) Int. Cl.

| | |
|---|---|
| *F25D 17/04* | (2006.01) |
| *F25D 23/02* | (2006.01) |
| *F25D 27/00* | (2006.01) |
| *F25D 29/00* | (2006.01) |

(52) U.S. Cl.
CPC ..... *F25D23/061* (2013.01); *F25D 27/00* (2013.01); *F25D 29/005* (2013.01); *F25D 2317/067* (2013.01); *F25D 2400/40* (2013.01)

(56) References Cited

U.S. PATENT DOCUMENTS

| | | | | |
|---|---|---|---|---|
| 2,514,631 | A | | 7/1950 | Elvers |
| 3,038,769 | A | | 6/1962 | Smith |
| 3,807,572 | A | | 4/1974 | Luvara et al. |
| 3,866,434 | A | * | 2/1975 | Pugh et al. ..... 62/340 |
| 4,006,947 | A | * | 2/1977 | Haag et al. ..... 312/406 |
| 4,384,751 | A | * | 5/1983 | Guntermann et al. ..... 312/265.4 |
| 4,426,120 | A | | 1/1984 | Johnson et al. |
| T104,002 | I4 | | 3/1984 | Morrison et al. |
| 4,729,183 | A | | 3/1988 | Tarter et al. |
| 4,774,740 | A | | 10/1988 | Gidseg et al. |
| 4,932,729 | A | * | 6/1990 | Thompson et al. ..... 312/405 |
| 5,199,273 | A | | 4/1993 | Silva et al. |
| 5,211,292 | A | | 5/1993 | Paolucci |
| 5,220,747 | A | * | 6/1993 | Cherry et al. ..... 49/386 |
| 5,269,602 | A | | 12/1993 | Kuwahara et al. |
| 5,527,103 | A | | 6/1996 | Pittman |
| 5,624,118 | A | | 4/1997 | Gottesman |
| 5,666,764 | A | | 9/1997 | Beatty et al. |
| 5,775,046 | A | | 7/1998 | Fanger et al. |
| 5,909,937 | A | | 6/1999 | Jenkins et al. |
| 5,921,646 | A | | 7/1999 | Hwang |
| 5,931,554 | A | * | 8/1999 | Koopman ..... 312/405 |
| 6,012,790 | A | | 1/2000 | Thomas et al. |
| 6,047,647 | A | | 4/2000 | Laraia, Jr. |
| 6,102,217 | A | * | 8/2000 | Mathy et al. ..... 211/85.7 |
| 6,216,894 | B1 | * | 4/2001 | Hendricks ..... 211/194 |
| 6,460,955 | B1 | | 10/2002 | Vaughan et al. |
| 6,485,122 | B2 | | 11/2002 | Wolf et al. |
| 6,657,861 | B2 | | 12/2003 | Irmer |
| 6,918,341 | B1 | | 7/2005 | Welsch et al. |
| 6,932,443 | B1 | | 8/2005 | Kaplan et al. |
| 2004/0012315 | A1 | | 1/2004 | Grace et al. |
| 2005/0077806 | A1 | * | 4/2005 | Schellenberg ..... 312/400 |

FOREIGN PATENT DOCUMENTS

| | | |
|---|---|---|
| EP | 0893659 | 1/1999 |
| FR | 2812078 | 1/2002 |
| JP | 3211383 | 9/1991 |

* cited by examiner

MODULAR REFRIGERATION AND/OR FREEZER APPLIANCE

CROSS-REFERENCE TO RELATED APPLICATIONS

This application is a continuation of U.S. patent application Ser. No. 10/599,900, filed Jun. 5, 2007, which claims priority on International Application No. PCT/EP2005/051633, filed Apr. 13, 2005, which claims priority on Italian Application No. MI2004A000737, filed Apr. 14, 2004.

BACKGROUND OF THE INVENTION

The present invention relates to a modular refrigeration and/or freezer appliance in accordance with the introduction to the main claim. In particular, it relates to the structure of a refrigeration and/or freezer appliance or the like, and to its components, which are such as to render the structure sectional and adaptable to the most varied requirements.

As known to the expert of the art, known refrigeration appliance structures are formed from a plurality of panels and profile bars joined together by screw means or by injected insulating material (foam) made to expand between said panels and profile bars; the same insulating material maintains the panels and profile bars joined together. This involves considerable assembly times and high costs in terms of the labour required to handle a large number of pieces and to properly assemble them.

A first problem derives from the fact that the means for coupling the various module components together are such that once the refrigeration or freezer appliance has been assembled, it cannot be easily disassembled.

In addition, alignment between the various module components, for example in the case of assembly by means of foam, is particularly critical and must be delegated to expert qualified, and hence costly, personnel possibly using templates or support jigs.

Moreover, the structure of such refrigerators, being based on a number of structural parts joined together to form a frame, does not present good structural rigidity as the connections between the various panels are delegated merely to the injected insulating material.

In addition, the joining together of various structural parts typically results in a worsening of the thermal insulation of the cabinet, as the connections between the various panels introduce material continuity between the external environment and the interior of the refrigerated compartment, resulting in poorer insulation characteristics than commonly used expanded materials, hence giving rise to thermal bridges which increase heat transfer between the external environment and the thermally insulated compartment.

DE 1911903 describes a horizontal modular refrigerator cabinet consisting of a plurality of U-shaped structural modules of rigid foamed material disposed horizontally side by side such that the side walls of each U-shaped module define the upper and lower walls of the refrigerator cabinet. The refrigeration compartment is closed frontally by doors and laterally by flat panels of the same material with which the modules are made. The said patent does not provide details of how such flat panels are fixed to the ends of the U-shaped modules, which are abuttingly joined to each other. Moreover, such a type of cabinet is suitable more for commercial use (bars, beer houses, etc.) than for domestic use, as the U-shaped elements define a sort of refrigerated counter.

SUMMARY OF THE INVENTION

A modular refrigeration and/or freezer appliance according to one embodiment of the invention includes a base module, a cabinet module comprising U-shaped front and rear plates defining a structure with an open top, bottom, and front, with the front and rear plates spaced from each other to define therebetween a U-shaped insulation compartment with upper and lower edges, an insulation module received within the U-shaped insulation compartment, a bottom closure wall module, a top closure wall module, and a door hingedly coupled to the base module and the cabinet module to selectively close the open front of the cabinet module.

A modular refrigeration and/or freezer appliance according to another embodiment of the invention includes a base module, a first cabinet module comprising U-shaped front and rear plates defining a structure with an open top, bottom, and front, with the front and rear plates spaced from each other to define therebetween a first U-shaped insulation compartment with upper and lower edges, an insulation module received within the first U-shaped insulation compartment, a second cabinet module arranged vertically with the first cabinet module and comprising U-shaped front and rear plates defining a structure with an open top, bottom, and front, with the front and rear plates spaced from each other to define therebetween a second U-shaped insulation compartment with upper and lower edges, an insulation module received within the second U-shaped insulation compartment, a bottom closure wall module, a top closure wall module, and a door hingedly coupled to the base module and the cabinet module to selectively close the open front of the cabinet module.

BRIEF DESCRIPTION OF THE DRAWLINGS

Further characteristics and advantages of the invention will be apparent from the description of a preferred but non-exclusive embodiment of the modular refrigeration and/or freezer appliance, illustrated by way of non-limiting example in the accompanying drawings, in which.

DESCRIPTION OF THE PERFERRED EMBODIMENTS

The figures show a modular refrigeration and/or freezer appliance indicated overall by 1. It comprises a base module 2 for containing the components 2A necessary to obtain the refrigeration effect within the appliance, and in particular a compressor, a condenser and a cooling fan with respective drive motor. These components 2A are of conventional type and will therefore, not be further described.

The base module 2 presents a lower plate 3 from which a pair of lateral walls 4*a*, 4*b* branch, on the flat top 5*a*, 5*b* of which means 6*a* are provided for its connection to other corresponding modules, which will be described hereinafter. Said connection means in FIG. 1 consist of guides 6*a* of inverted double L shape. The particular shape of these guides gives them slight elasticity, which is very useful for improving the seal when coupled to a corresponding counter-guide 6*b*. These counter-guides 6*b* are facingly present on both the lower and upper sides of the branches 7*a*, 7*b* of a first reversible U-shaped profile bar 7. The counter-guides 6*b* and their arrangement are well visible in FIG. 2A; they are substantially T-shaped, the guides 6*a* sliding within them with slight interference. The connection is particularly stable in that it utilizes the said elasticity of the inverted L-shaped profile bar of the guides 6*a*, the connection being perfectly sealed.

Figure 2:
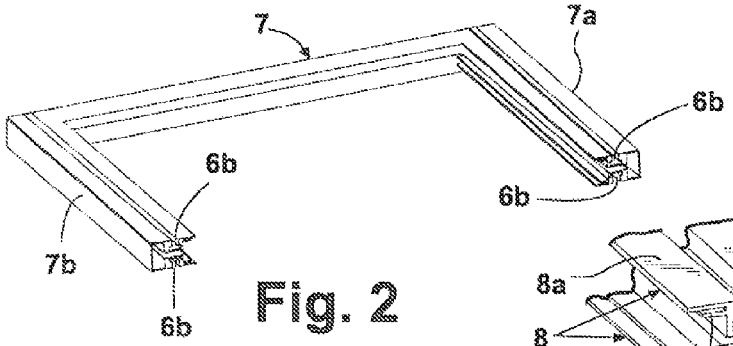
FIGS. 2 and 3 are perspective views of details of the refrigerator of FIG. 1.
Figure 2A:
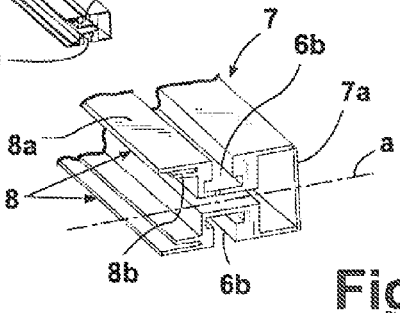
FIGS. 2A and 3A are enlarged perspective views of details of FIGS. 2 and 3 respectively.

The U-shaped profile bar 7, of cross-section symmetrical about the axis "a" of FIG. 2A, presents further guide slots 8. The guide slots 8, also double given the symmetry of the U-shaped profile bar, are formed of first outer flanges 8*a*, exceeding second inner flanges 8*b* in length. The slots act as a seat for two panels 9, which will be described in detail hereinafter.

Figure 1A:
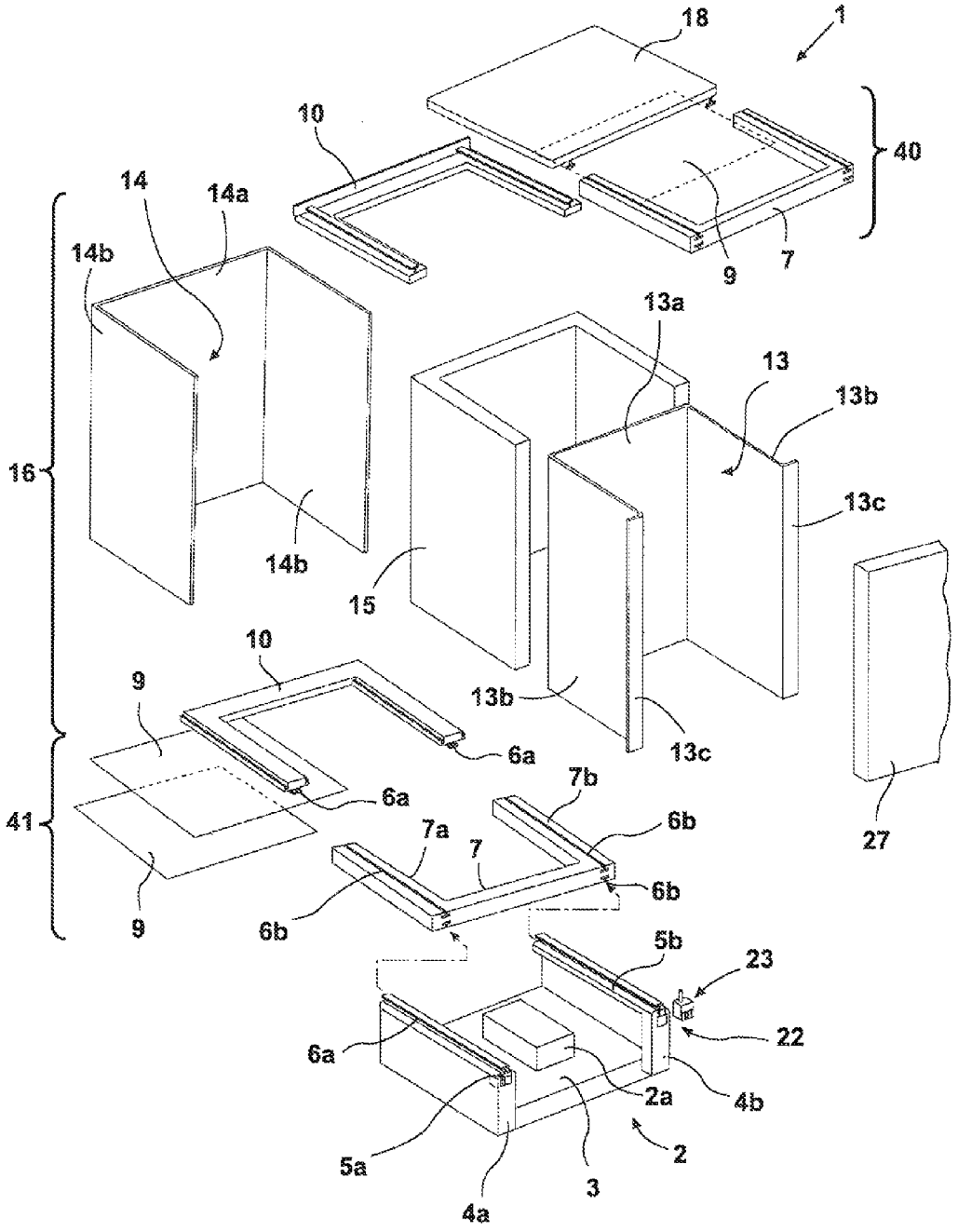
FIG. 1A is a schematic exploded view of a modular refrigerator of the present invention.
Figure 1B:
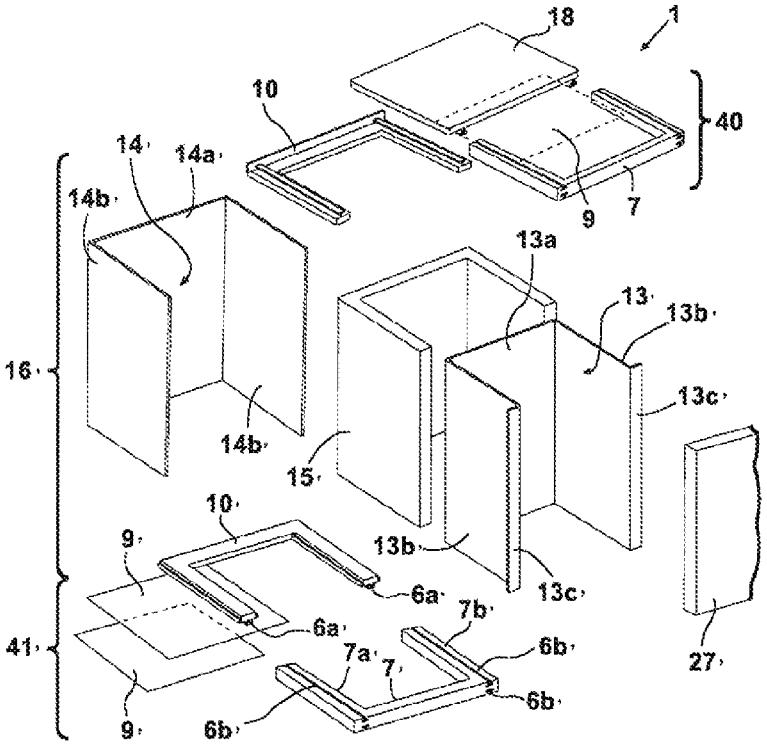
FIG. 1B is a schematic view of a modular refrigerator of the present invention showing a first and second cabinet module.
Figure 1B:
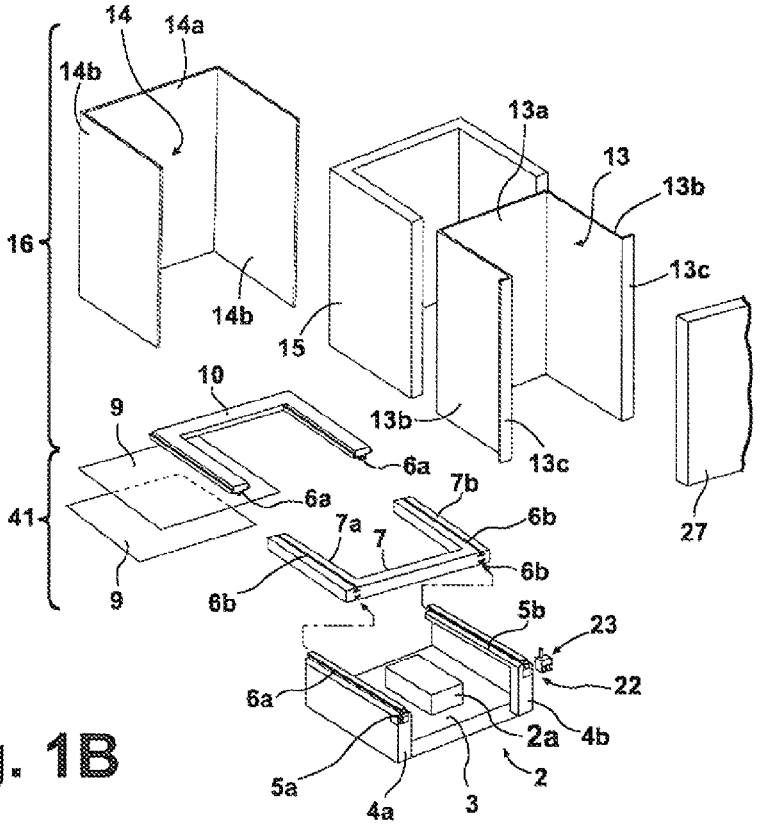

As is evident in FIG. 1, the first U-shaped profile bar 7 is mounted from the front onto the base module 2 by sliding the guides 6*a* of the base module 2 within the counter-guides 6*b* of the bottom of the U-shaped profile bar 7. Identical panels 9 are slid within the upper and lower guide slots 8, before mounting the U-shaped profile bar 7 on the base module 2. The panels 9 are hence well secured and, together with the inner walls of the U-shaped profile bar 7 and the wall 11 of a second U-shaped profile bar 10 (described hereinafter), form a compartment which when injected with insulating material, for example foamed polyurethane, forms the bottom panel 41 of the refrigeration appliance compartment.

Figure 3:
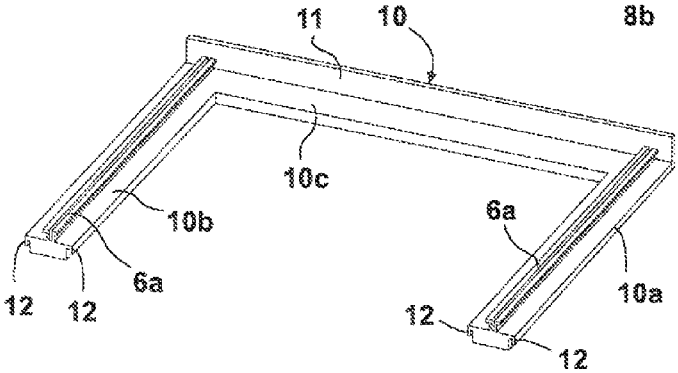
Figure 3A:
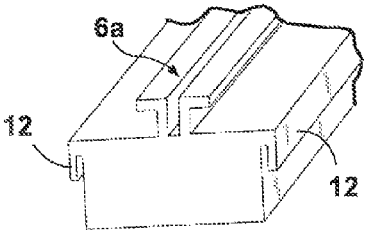
Figure 5:
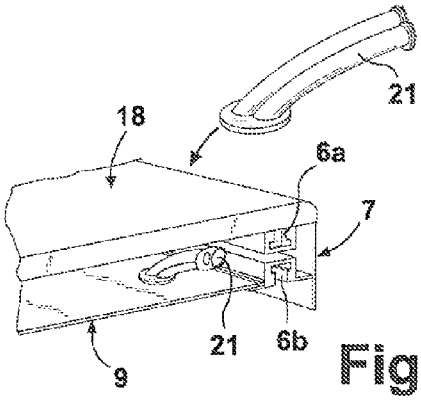
Figure 6:
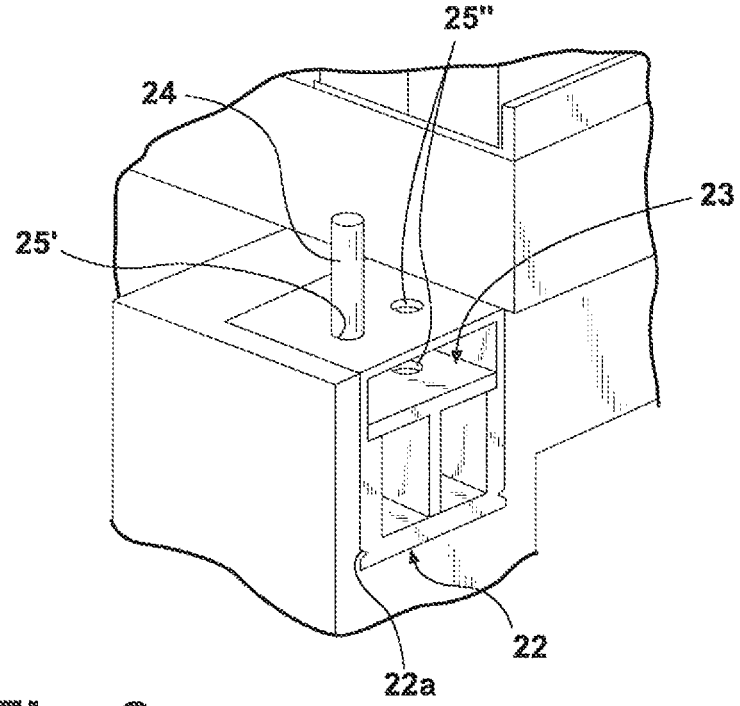
FIGS. 6, 7A, 7B are enlarged views of a detail of FIG. 1.

The second U-shaped profile bar 10, shown in its entirety in FIG. 3 (and in detail in FIG. 3A), presents, on the upper surface of two lateral branches 10*a, b*, guides which are totally similar to those presented by the base module 2 and already described. On the third branch 10*c*, which joins the lateral branches together, there is a wall 11 of height at least equal to the height of the U-shaped profile bar 7. The second U-shaped profile bar 10 also laterally presents further seats 12 for a front plate 13 and a rear plate 14 inserted head-on into said seats 12.

In the illustrated example, the front plate 13 is a bent enamelled metal sheet, presenting a rear part 13*a*, two side parts 13*b* disposed as the sides of a U, and two front parts 13*c* bent at a right angle to the side parts 13*b*. This front plate 13 will form the interior of the refrigeration appliance compartment.

The rear plate 14 presents only a rear part 14*a* and two side parts 14*b*, which also form a U cross-section. This rear plate will form the rear and side exterior of the appliance.

In assembly, the front plate 13 and rear plate 14 are positioned face to face and inserted head-on into the seats 12 of two second U-shaped profile bars 10, one disposed upperly and one lowerly. Between the profile bars and plates there is thus created a U-shaped compartment which when filled with foamed insulating material 15 consolidates the structure. The combination forms an insulated U-shaped module 16 which is structurally very rigid.

The U-shaped module 16 is then joined to the base module 2, specifically to the first U-shaped profile bar 7 already mounted on the base module 2 and fixed to it by means of the guides 6*a*.

Figure 4:
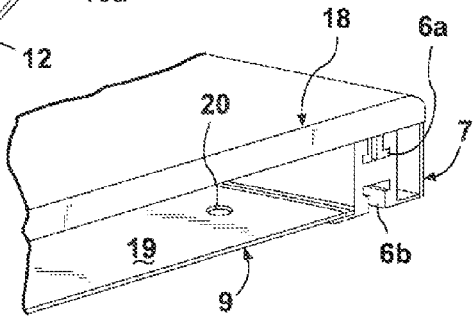
FIG. 4 and FIG. 5 are perspective views of details of the refrigerator of FIG. 1 assembled.

The top 40 of the refrigeration appliance is formed by again using a first U-shaped profile bar 7, identical to that already described, in which a panel 9 is lowerly inserted and an upper panel 18 is upperly inserted carrying lower guides 6*a* for engagement with the U-shaped profile bar 7. FIG. 4 shows this connection in detail, and highlights the compartment 19 which is to be filled with insulating material. In this latter, and specifically in the panel 9 or flat module, one or more holes 20 can be provided to allow passage of electric cables or conduits for refrigerant fluid via suitably provided channels 21.

A refrigerator has so far been described formed from a single U-shaped module 16 mounted on a base 2 (via an interposed bottom panel 41) and closed upperly by a top 40, as shown in FIG. 1A, however, as illustrated in FIG. 1B which shows a first, upper cabinet 16' and a second lower cabinet 16 having parts corresponding to those of cabinet 16, the modular refrigerator of the invention can be formed from several superposed U-shaped modules 16, 16' joined together at flat joining and stiffening panels such as intermediate closing panel 41' similar to the bottom panel 41, i.e. provided with the same counter-guides 6*b* described with reference to the bottom panel 41 and to the top 40 and labeled as 6*b*'. In this manner, each U-shaped module 16, 16' can be rapidly mounted on the underlying module by using the flat joining and stiffening panels 41, 41'.

In the base module 2 a seat 22 is provided in each side wall 4*a*, 4*b* for housing a hinge module 23. The hinge module 23 lowerly presents a dovetail profile 23*a* to slidingly engage a corresponding profile 22*a* of the seat 22. The hinge module is locked in the seat 22 by an elastic tang (not visible) acting on its base.

The hinge module, which can be mounted on the right or left depending on the direction of opening of the door 27, presents a pin 24 housed in holes 25' or 25". The pin is housed in the holes 25' or 25" depending on the direction of opening of the refrigeration appliance door 27. The pin 24 is fixed by bayonet insertion using a lever 26 removably applicable to the pin 24.

When in use, the refrigerator door 27 is hence hinged lowerly about the pin 24 and upperly by conventional inserts fixed for example to the upper U-shaped profile bar 7.

Figure 7A:
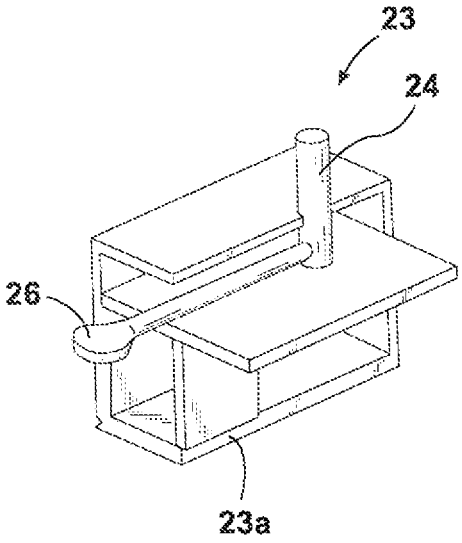
Figure 7B:
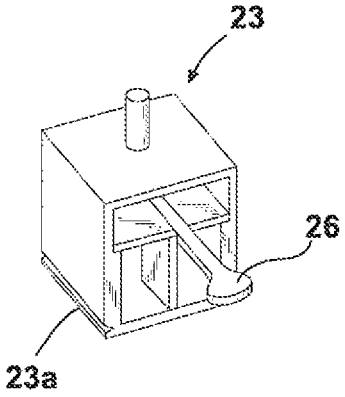

In a different embodiment shown in FIGS. 7A, B, only a single hole is provided to house the pin 24. The lever 26 for manipulating the pin 24 can be seen in these figures.

By joining together the aforedescribed components, an adaptable modular refrigerator is formed, the described components giving it the maximum degree of flexibility.

Figure 8:
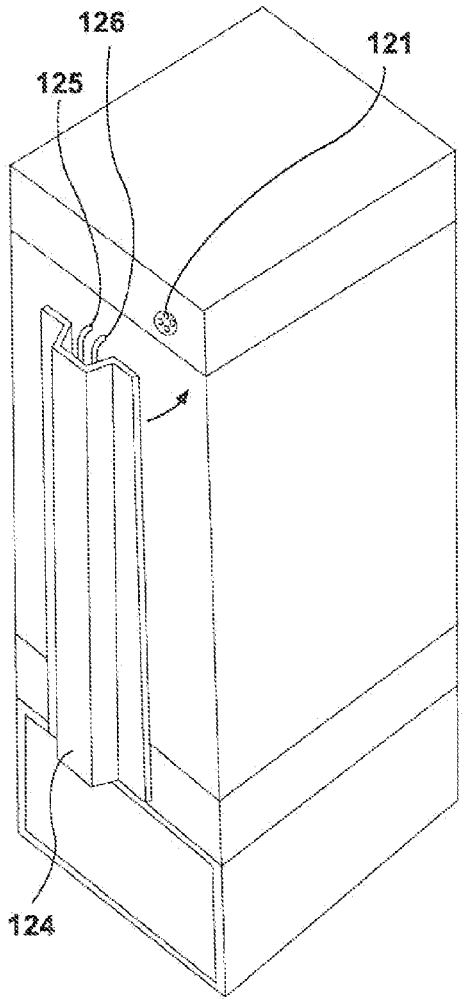
FIGS. 8 and 9 are rear perspective views of a refrigerator of the invention, showing a conduit-like element in a pre-assembly configuration and respectively in an assembled configuration mounted on the rear wall of the refrigerator.
Figure 9:
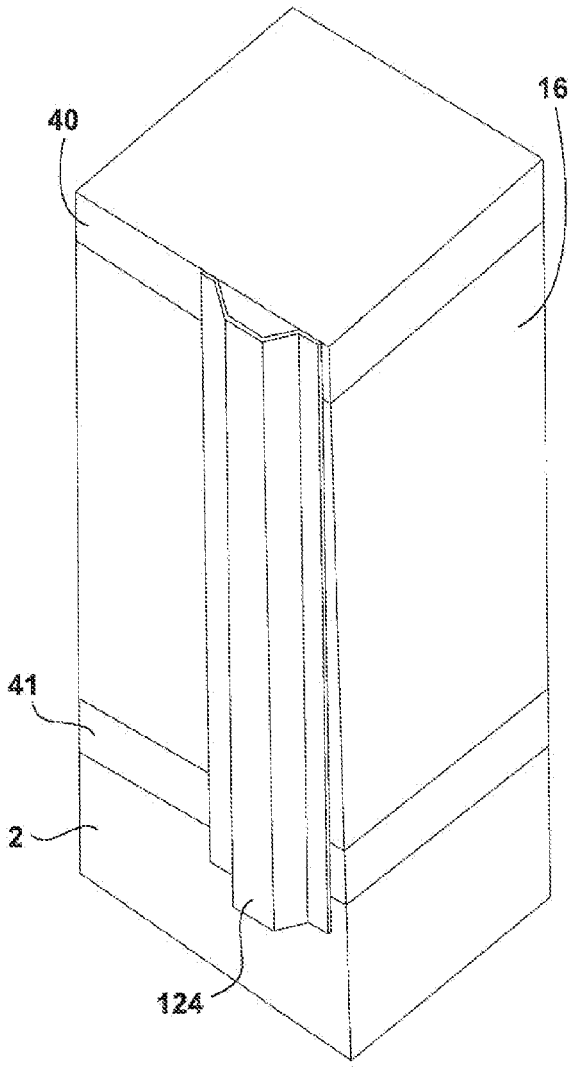

A different embodiment is shown in FIGS. 8 and 9 in which a channel 124 is connected vertically to the rear of the U-shaped module 16, and to the bottom and top panels 41 and 40 respectively. Cables 125 and/or pipes 126 pass through the channel 124. The method of connecting the channel 124 to the refrigerator cabinet is not shown in the drawings, but can be by traditional fixing systems (snap-insertion, gluing, welding).

Figure 10:
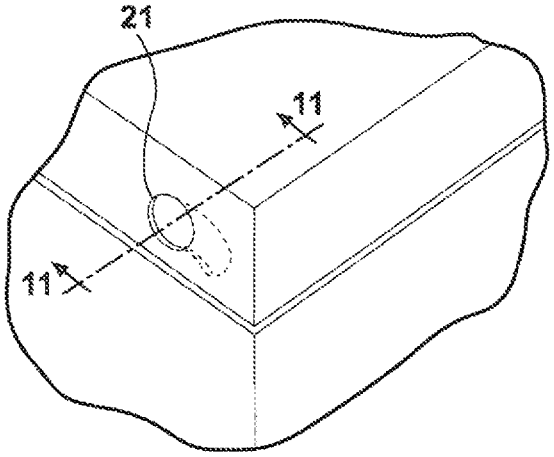
FIG. 10 is a perspective view of a first variant of a detail of the assembled modular refrigerator.
Figure 11:
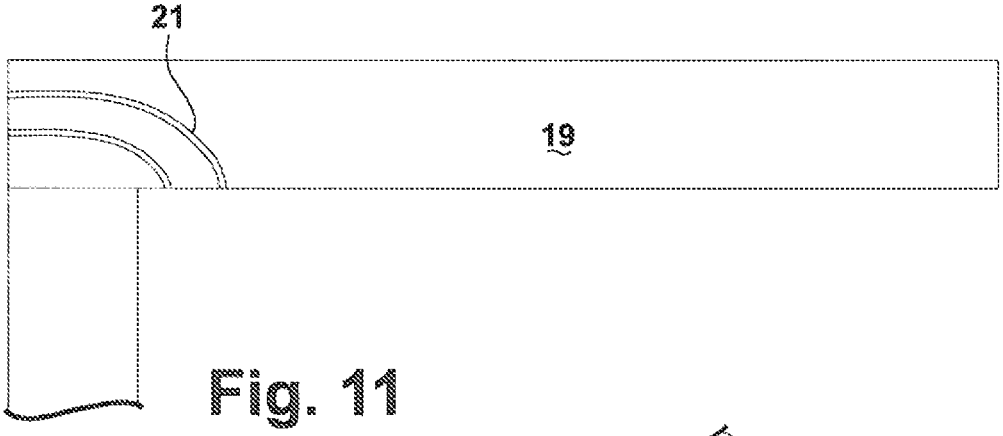
FIG. 11 is a section on the line XI-XI of FIG. 10.
Figure 12:
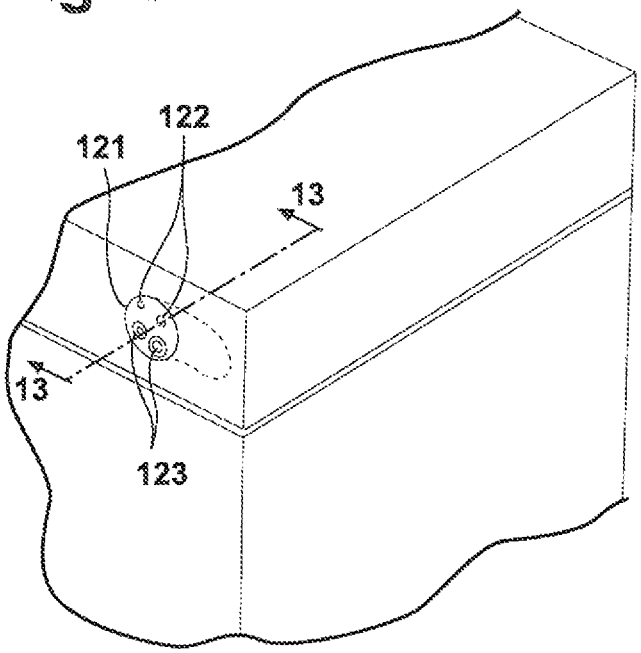
FIG. 12 is a perspective view of a further variant of the assembled modular refrigerator of the invention.
Figure 13:
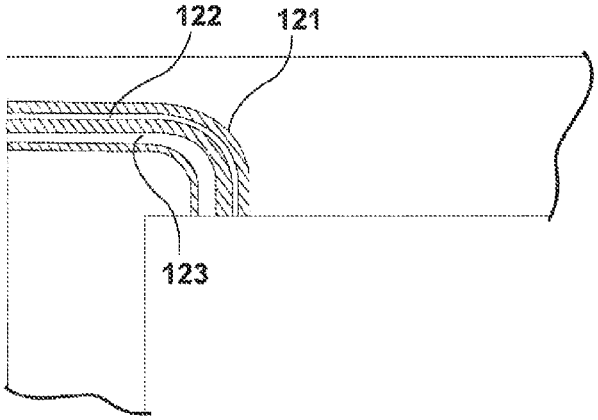
FIG. 13 is a section on the line XIII-XIII of FIG. 12.

In the variant shown in FIGS. 10 and 11 the top panel 40 (or an intermediate flat element in the case of several superposed U-shaped modules) is provided with an internal conduit 21 to connect the rear wall of the cabinet, provided with the channel 124, to the cell interior. In this configuration the channel 124 acts to convey refrigerated air from the base module 2 to the cell and vice versa. Again in this configuration, the channel can instead act as a simple passage for the circuit pipes and electric cables. In a similar manner, in the variant shown in FIGS. 12 and 13, preinstalled cables 122 and/or pipes 123 are run inside channels 121 provided in the top panel 40 (or in an intermediate flat element in the case of several superposed modules) and can then be connected to the rest of the electrical/electronic circuit, and in particular to the cables and pipes (125, 126) mounted in the channel 124 using suitable connectors (not shown).

Figure 14:
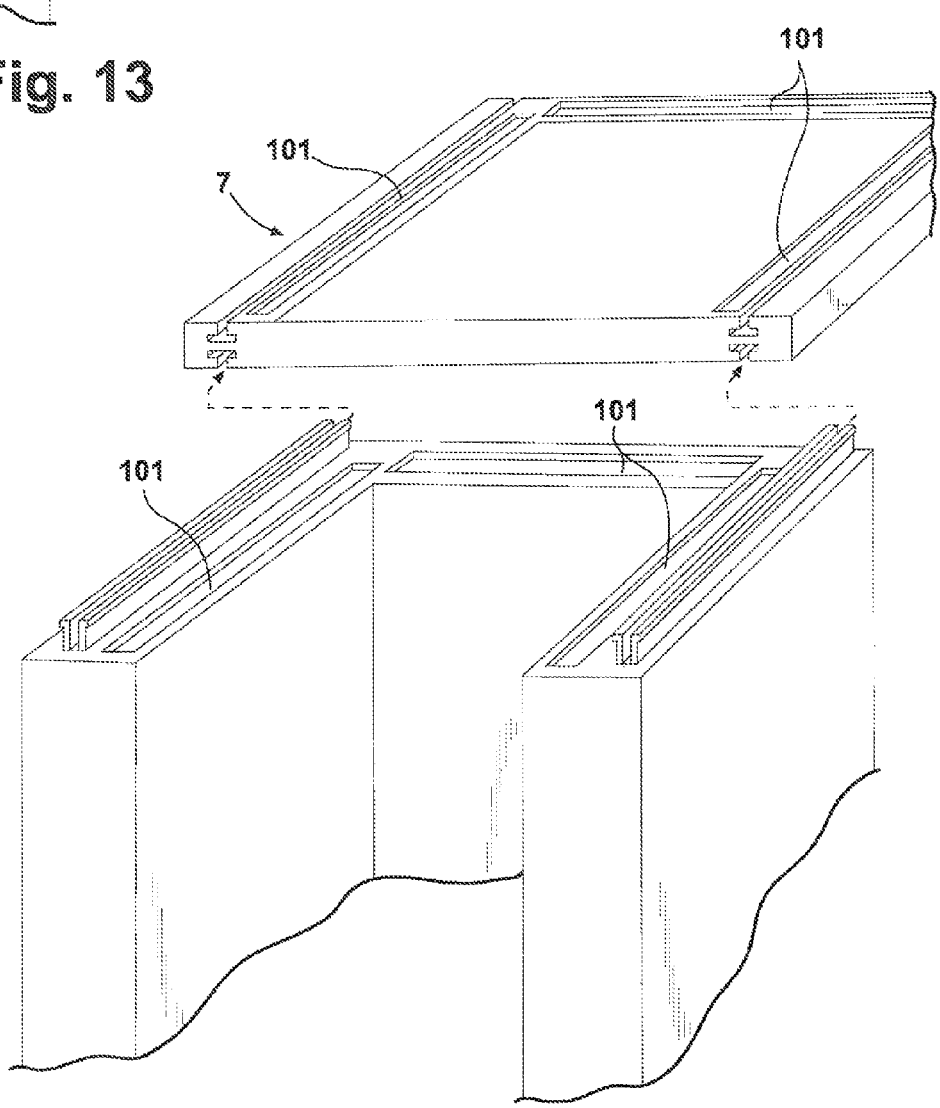
FIG. 14 is a perspective view of a further variant of the modular refrigerator of the invention, in which the thermal bridges are further reduced.

In a different embodiment of the modular refrigeration appliance, shown in FIG. 14, the bars 7, 10 on which the guides and counter-guides 6*a* and 6*b* are provided present suitable discontinuities 101 in their constituent materials. By interrupting the continuity of these materials the thermal bridges between the external environment and the thermally insulated compartments are minimized.

Figure 15:
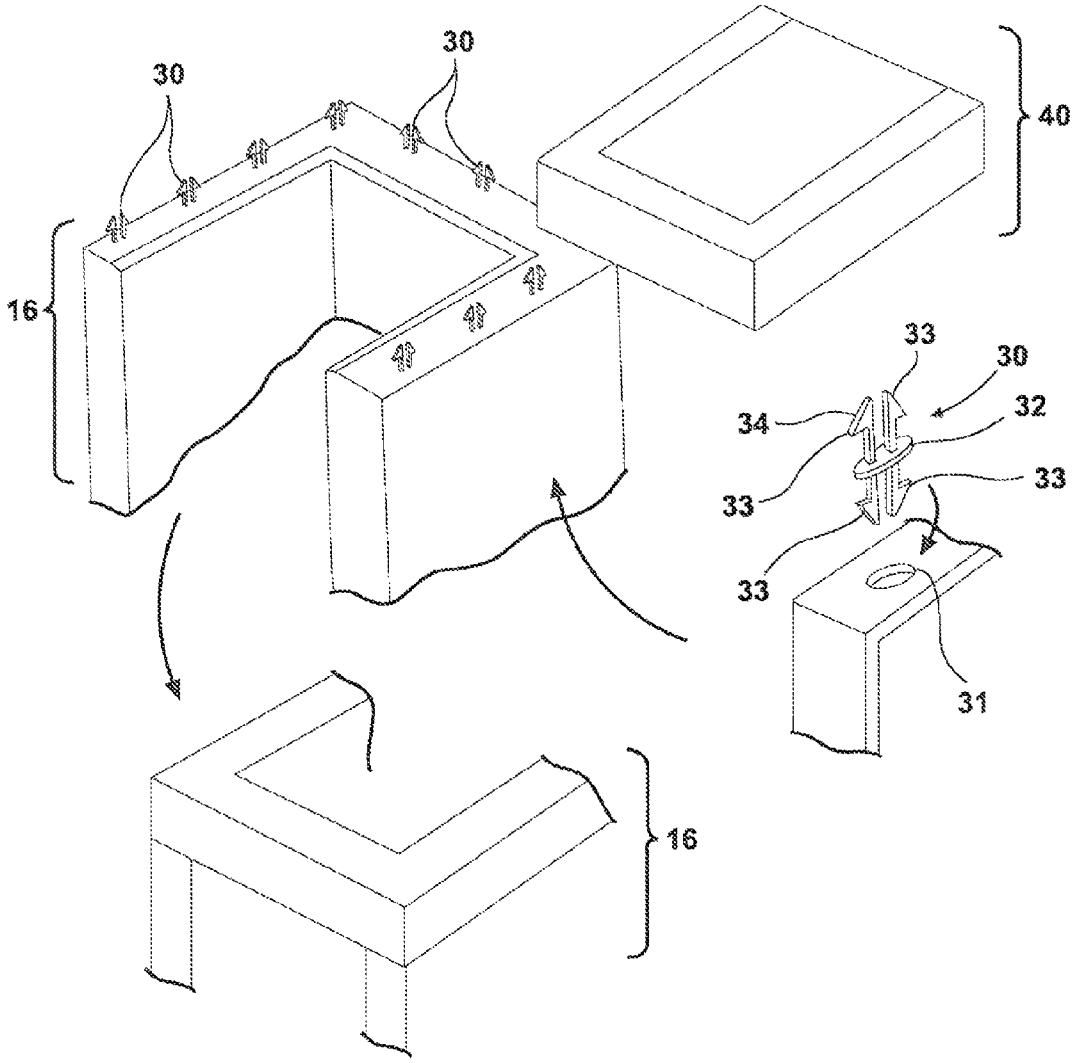
FIG. 15 is a schematic view of a different embodiment of the refrigeration appliance of the present invention.

In a different embodiment of the modular refrigeration appliance, shown in FIG. 15, the connection means consisting of guides 6*a* and counter-guides 6*b* can be replaced by couplings 30 snap-cooperating with suitable seats 31 provided in the first and second U-shaped profile bar 10 and in the upper panel 18, for the rest they being entirely similar to those already described.

The couplings 30 present a substantially flat elongate body 32 from which there symmetrically extend, both lowerly and upperly, pairs of elastic appendices 33 provided with facilitated-engagement teeth 34 to engage said seats 31. Once engaged in the seats 31, these couplings 30 are incorporated into the foamed insulating material injected into the compartments of the framework, hence rendering the connection between the different modular parts very stable.

Figure 16:
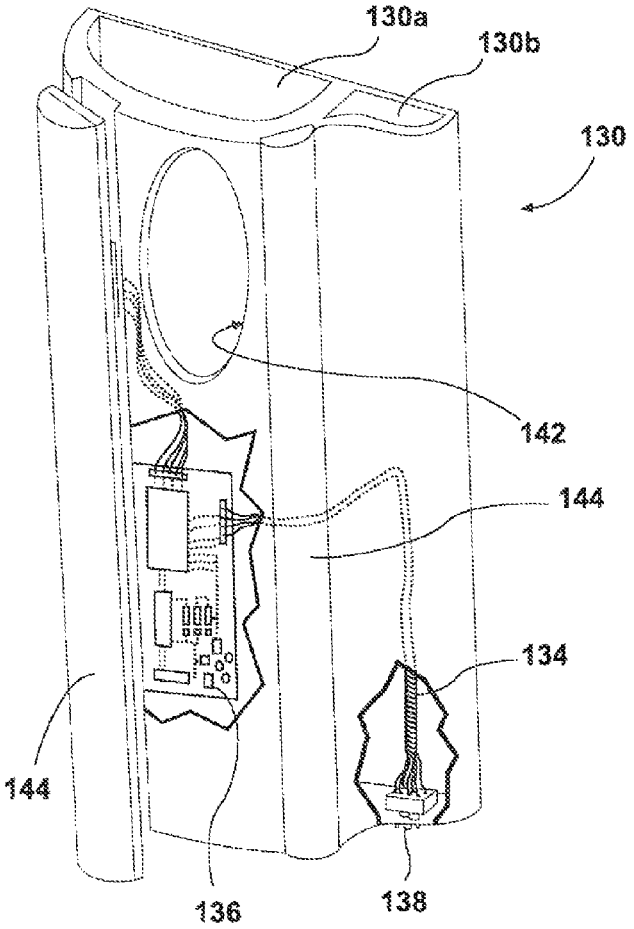
FIG. 16 is a perspective view of an air duct to be used in the refrigerator according to the invention.
Figure 17:
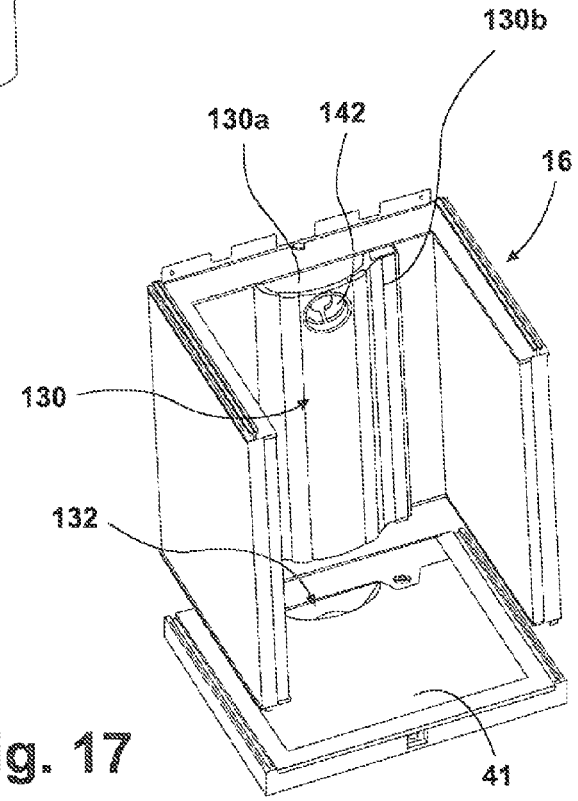
FIG. 17 is a perspective view of two elements of the refrigerator according to the invention, in which the air duct of FIG. 16 is used.

Instead of using a channel 124 (FIGS. 8 and 9) connected to the rear side of the U-shaped module 16, it is possible to use an internal air duct 130 as shown in FIGS. 16 and 17. The duct 130 conveys the refrigerated air to the cavities and drives air inside each cavity. Moreover the duct 130 is a device that integrates all the needed function inside each cavity, i.e. to convey and drive air into the cavity, to generate light inside the cavity, and to sense one or more physical entity inside the cavity (e.g. temperature, humidity, odor, etc.). The duct 130 is provided with a main channel 130*a* and with an auxiliary side channel 130*b*. The main channel 130*a* is connected to a seat 132 of the bottom panel 41 and to a seat (not shown) of the top panel. The seat 132 is then connected (on its lower side) to the base module 2 where refrigerated air is driven to such seat.

In the auxiliary side channel 130*b* there are provided wires 134 for connecting an electronic control board 136 that communicates with the base module 2 through a bus connection. The sensors (not shown) are connected to the electronic control board 136 and a connector 138 is provided in the auxiliary channel 130*b* for fast connection (only one of such connectors 138 is shown in FIG. 16). The control board 136 drives also electrical dampers or valves 140 placed in a corresponding aperture 142 of the channel 130*a* for adjusting the flow of cold air to the cavity.

Another function of the air duct 130 is to support a fan (not shown) associated with the aperture 142, and to support lamps 144 (for instance LED, OLED, electroluminescent polymers etc.). The use of the air duct 130 allows a very easy and fast assembly of a modular refrigerator according to the invention. Moreover the duct 130 can be used in a modular architecture since it presents standard interfaces (mechanical and electrical) to one of the structural module of the refrigerator and hence can be differentiated among the product range to better follow customer needs. Moreover the duct 130 (and all components integrated therein) can be easily disassembled and replaced in case of failure or in case of upgrade.

Various embodiments have been described, however others can be conceived using the same inventive concept.

What is claimed is:

1. A modular refrigeration appliance comprising:

a base module comprising a bottom wall and opposed side walls extending from the bottom wall to partially define an open-top chamber containing a portion of a refrigeration system, with the side walls defining an upper edge for the base module;

a cabinet module comprising U-shaped front and rear plates defining a structure with an open top, bottom, and front, with the front and rear plates spaced from each other to define therebetween a U-shaped insulation compartment with upper and lower edges;

an insulation module received within the U-shaped insulation compartment;

a bottom closure wall module interposed between the base module and the cabinet module and connecting the upper edge of the base module to the lower edge of the cabinet module while closing the bottom of the cabinet module and covering the portion of the refrigeration system;

a top closure wall module connected to the upper edge of the cabinet module and closing the top of the cabinet module; and a door adapted to be hingedly coupled to the base module and the cabinet module to selectively close the open front of the cabinet module.

2. The appliance of claim 1 further comprising a hinge module mounted to the base module and adapted to be hingedly coupled to the door.

3. The appliance of claim 2 wherein the door comprises a hinge pin and the hinge module includes holes to receive the hinge pin.

4. The appliance of claim 1 wherein the bottom closure wall module comprises a lower U-shaped profile bar mounted to the upper edge of the base module, an upper U-shaped profile bar mounted to the lower edge of the cabinet module, a lower panel disposed between the lower and upper U-shaped profile bars, wherein the lower and upper U-shaped profile bars are coupled to each other to connect the base module to the cabinet module and the lower panel closes the open top of the base module and the open bottom of the cabinet module.

5. The appliance of claim 4 wherein the top closure wall module comprises a lower U-shaped profile bar mounted to the upper edge of the cabinet module, an upper U-shaped profile bar mounted to the lower U-shaped profile bar, and an upper panel disposed between the lower and upper U-shaped profile bars of the top closure wall module, wherein the upper panel closes the open top of the cabinet module.

6. The appliance of claim 5 wherein at least one of the lower panel and upper panels comprises a horizontal flat panel provided with an opening which enables at least one of cables and pipes to pass there through.

7. The appliance of claim 5 wherein the lower and upper U-shaped profile bars of the top closure wall module further comprise guide slots that receive the upper panel.

8. The appliance of claim 4 wherein the lower and upper U-shaped profile bars of the bottom closure wall module further comprise guide slots that receive the lower panel.

9. The appliance of claim 1, further comprising an air duct provided on the cabinet module and coupled to at least one of the top closure wall module and the bottom closure wall module.

10. The appliance of claim 9 wherein the air duct includes at least one controlled aperture configured to feed refrigerated air into an interior partially defined by the cabinet module.

11. The appliance of claim 10 wherein the air duct further comprises an electronic circuit coupled to a control unit of the appliance, sensors linked to the electronic circuit, and illumination sources.

12. A modular refrigeration or freezer appliance comprising:

a base module comprising a bottom wall and opposed side walls extending from the bottom wall to partially define an open-top chamber containing a portion of a refrigeration system, with the side walls defining an upper edge for the base module;

a first cabinet module comprising U-shaped front and rear plates defining a structure with an open top, bottom, and front, with the front and rear plates spaced from each other to define therebetween a first U-shaped insulation compartment with upper and lower edges;

a first insulation module received within the first U-shaped insulation compartment;

a second cabinet module arranged vertically with the first cabinet module and comprising U-shaped front and rear plates defining a structure with an open top, bottom, and front, with the front and rear plates spaced from each other to define therebetween a second U-shaped insulation compartment with upper and lower edges;

a second insulation module received within the second U-shaped insulation compartment;

a bottom closure wall module interposed between the base module and the second cabinet module and connecting the upper edge of the base module to the lower edge of the second cabinet module while closing the bottom of the second cabinet module and covering the portion of the refrigeration system;

a top closure wall module connected to the upper edge of the first cabinet module and closing the top of the first cabinet module; and a door adapted to be hingedly coupled to the base module and the first and second cabinet modules to selectively close the open fronts of the first and second cabinet modules.

13. The appliance of claim 12, further comprising a hinge module mounted to the base module and adapted to be hingedly coupled to the door.

14. The appliance of claim 13 wherein the door comprises a hinge pin and the hinge module includes a hole for receiving the hinge pin.

15. The appliance of claim 12 wherein the bottom closure wall module comprises a lower U-shaped profile bar mounted to the upper edge of the base module, an upper U-shaped profile bar mounted to the lower edge of the second cabinet module, a lower panel disposed between the lower and upper U-shaped profile bars, wherein the lower and upper U-shaped profile bars are coupled to each other to connect the base module to the second cabinet module and the lower panel closes the open top of the base module and the open bottom of the second cabinet module.

16. The appliance of claim 15 wherein the top closure wall module comprises a lower U-shaped profile bar mounted to the upper edge of the first cabinet module, an upper U-shaped profile bar mounted the lower U-shaped profile bar, and an upper panel disposed between the lower and upper U-shaped profile bars of the top closure wall module, wherein the upper panel closes the open top of the first cabinet module.

17. The appliance of claim 16, further comprising an intermediate closure module to close the open top of the second cabinet module and the open bottom of the first cabinet module.

18. The appliance of claim 17 wherein the intermediate closure wall module comprises a lower U-shaped profile bar mounted to the upper edge of the second cabinet module, an upper U-shaped profile bar mounted to the lower edge of the first cabinet module, an intermediate panel disposed between the lower and upper U-shaped profile bars, wherein the lower and upper U-shaped profile bars are coupled to each other to connect the first cabinet module to the second cabinet module and the intermediate panel closes the open top of the second cabinet module and the open bottom of the first cabinet module.

19. The appliance of claim 12, further comprising an intermediate closure module to close the open top of the second cabinet module and the open bottom of the first cabinet module.

20. The appliance of claim 19 wherein the intermediate closure wall module comprises a lower U-shaped profile bar mounted to the upper edge of the second cabinet module, an upper U-shaped profile bar mounted to the lower edge of the first cabinet module, an intermediate panel disposed between the lower and upper U-shaped profile bars, wherein the lower and upper U-shaped profile bars are coupled to each other to connect the first cabinet module to the second cabinet module and the intermediate panel closes the open top of the second cabinet module and the open bottom of the first cabinet module.

* * * * *